United States Patent [19]

Derbyshire

[11] 3,935,889

[45] Feb. 3, 1976

[54] HAND TOOLS

[75] Inventor: George Cecil Derbyshire, Sheffield, England

[73] Assignee: The Jacobs Manufacturing Co., Ltd., Sheffield, England

[22] Filed: Nov. 21, 1974

[21] Appl. No.: 526,042

[30] Foreign Application Priority Data

Nov. 28, 1973 United Kingdom ..... 55259/73

[52] U.S. Cl. ..... 145/24; 30/168; 30/335; 30/339; 30/344; 145/50 B

[51] Int. Cl.[2] ..... B25D 3/00

[58] Field of Search ..... 145/24, 25, 26, 50 B; 30/168, 335, 339, 340, 342, 344

[56] References Cited

UNITED STATES PATENTS

| | | | |
|---|---|---|---|
| 545,528 | 9/1895 | Paul | 30/340 X |
| 751,848 | 2/1904 | Goldsmith | 30/344 X |
| 903,093 | 11/1908 | Howe | 145/24 |
| 3,703,036 | 11/1972 | Karubian | 30/339 |

FOREIGN PATENTS OR APPLICATIONS

| | | | |
|---|---|---|---|
| 769,621 | 6/1934 | France | 30/344 |

*Primary Examiner*—James L. Jones, Jr.
*Assistant Examiner*—J. T. Zatarga
*Attorney, Agent, or Firm*—Stephen J. Rudy

[57] ABSTRACT

A hand tool including a blade or tool part with a connected tang and a handle part with an aperture extending axially from one end for receiving the tang, a locking pin extending diametrically across the handle part and the tang being provided with a slot for the passage of said locking pin to a cross bore in the tang, the locking pin being rotatable or axially moveable to engage it with said cross bore.

1 Claim, 7 Drawing Figures

HAND TOOLS

The invention relates to hand tools and has for its object to provide an improvement therein.

According to the invention, a hand tool includes a blade or tool part with a connected tang, a handle part with an aperture extending axially from one end for receiving the tang, and locking means for locking the handle part on said tang, said locking means being constituted by a locking pin extending diametrically across the handle part intermediate the ends of the aperture for receiving the tang, and the tang being provided with a slot opening from its free end for the passage of the locking pin along said slot to a cross bore in said tang as the latter is received in the aperture in the handle part, the locking pin being rotatable or axially movable to engage it with the cross bore in the tang when the tang has been fully inserted in said handle part. The locking pin may be provided with oppositely disposed flats so that it can only be passed along the slot in the tang when appropriately orientated and in this case will preferably be provided with a lever pivotally connected to it at one end. The arrangement will preferably be such that when the handle has been secured to the tang the lever can be at least partly located in an inoperative position in a recess formed in the side surface of the handle part. Also in this case the locking pin will preferably be retained in position in the handle part by means of a spring clip fitted at its end remote from the lever, the arrangement being such that the spring clip allows some slight cross-movement of the locking pin when lugs formed on said lever bear against the handle part, conveniently through the intermediary of a washer, as the lever is pivoted to an operative position, the return movement of the locking pin under the action of said spring clip when the lever is returned to its inoperative position causing said lever to be maintained in closed condition in the recess formed in the side surface of the handle part. On the other hand the locking pin may be axially movable against the force of a spring, the arrangement being such that when the tang has been inserted in the handle part and the locking pin is released the force of the spring imparts a cross-movement to the locking pin to bring an enlargement formed on said pin into engagement with the cross bore in the tang. The tang will preferably be of cylindrical form and a shoulder will preferably be provided against which the handle part can abut when the tang has been inserted fully in the axially extending aperture. The slot in the tang will preferably be provided with a chamfer forming a lead-in for the locking pin as the tang is entered into the aperture in the handle part.

In order that the invention may be fully understood and readily carried into effect, the same will now be described, by way of example only, with reference to the accompanying drawings, of which:

Figure 1:
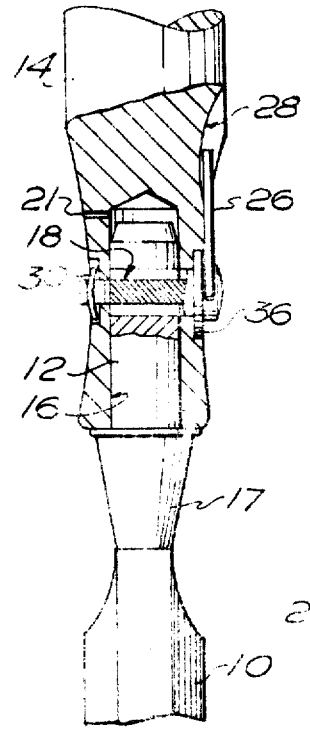
FIG. 1 is a part-sectional view through a hand tool embodying the invention.
Figure 2:
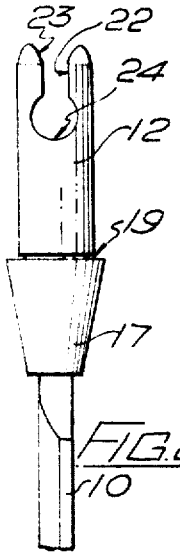
FIG. 2 is a view of the blade part thereof and a connected tang.

Referring now to FIGS. 1 to 5 of the drawings, the hand tool there illustrated includes a blade part 10 (in this case a blade) (blade) with an integral tang 12 of generally cylindrical form. A handle part 14 is provided with an aperture 16 extending axially from one end for receiving the tang. A bolster portion 17 which is formed integrally with the tang 12 provides a shoulder 19 which abuts against the end of the handle part when the two components have been fitted together. The handle part is provided with a small hole 21 which allows the flow of air from within the aperture 16 as the tang is received therein.

Locking means for locking the handle part on the tang of the blade part are constituted by a locking pin 18 with oppositely disposed flats 20, the locking pin extending diametrically across the handle part, as shown, intermediate the ends of the aperture 16. The tang 12 of the blade part is provided with a slot 22 opening from its free end for the passage of the locking pin, when appropriately orientated, along said slot to a cross bore 24 in said tang as the latter is received in the aperture in the handle part. The slot in the tang is provided with a generous chamfer 23 forming a lead-in for the locking pin as the tang is entered into the aperture in the handle part.

Figure 3:
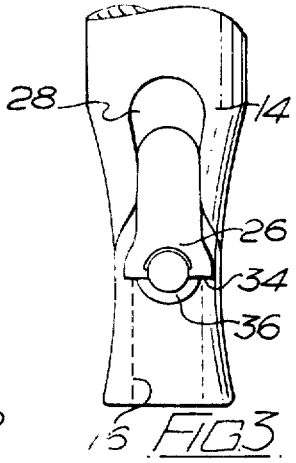
FIG. 3 is a side view of a handle part of the tool.
Figure 4:
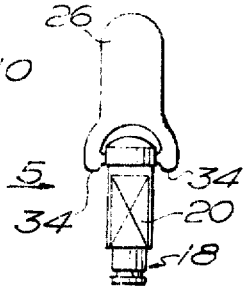
FIG. 4 is a side view of a locking pin for connecting the blade to the handle part.
Figure 5:
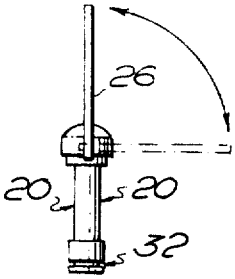
FIG. 5 is a view in the direction of arrow 5 in FIG. 4.

The locking pin 18 is rotatably mounted in the handle part so that it can be turned through a right angle to engage it with the cross bore 24 in the tang when the tang has been fully inserted in said handle part. A lever 26 is pivotally connected to one end of the locking pin for rotating the latter to engage it or disengage it with the cross bore in the tang, and the arrangement is such that, as shown in FIGS. 1 and 3, the lever can be partly located in an inoperative position in a recess 28 formed in the side surface of the handle part. The locking pin is retained in position in the handle part by means of a spring clip 30 fitted into a groove 32 at its end remote from the lever 26, and the arrangement is such that the spring clip allows some slight cross-movement of the locking pin when lugs 34 formed on said lever bear against a washer 36 which is disposed between the lever and the side surface of the handle part, that is to say as the lever is pivoted to an operative position in line with the axis of the locking pin. The movement of the locking pin under the action of the spring clip when the lever is returned to its inoperative position causes the lever to be maintained in closed condition in the recess 28 in the side surface of the handle part.

Thus there is provided a hand tool the blade and handle part of which can very quickly and conveniently be fixed together or separated one from the other. Consequently, the construction of tang and co-operating handle is such that a set of blades or tools can be provided with a single handle for selective fitment to one of the blades or tools which it is desired to use.

Figure 6:
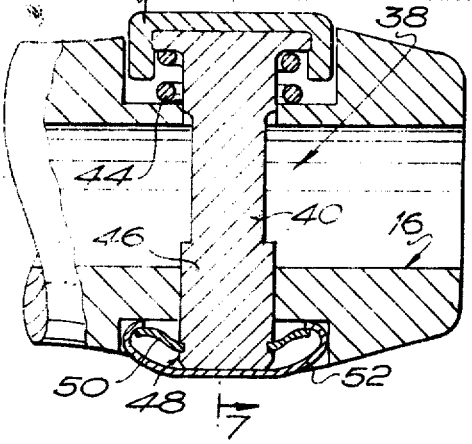
FIG. 6 is a part-sectional view through a hand tool of modified construction.
Figure 7:
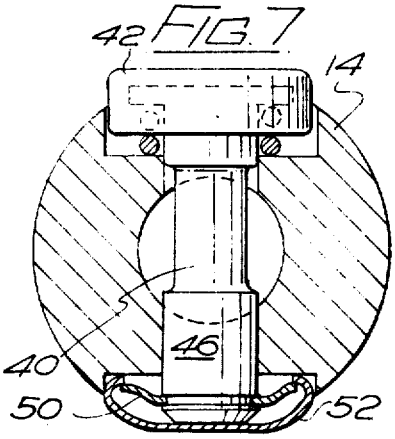
FIG. 7 is a sectional view on the line 7—7 in FIG. 6.

Referring now to FIGS. 6 and 7, in a modification of the hand tool just described the locking means constituted by the locking pin 18 with oppositely disposed flats has been replaced by a locking pin 38 which is of cylindrical form throughout, that is to say having a cylindrical major length 40 longer than the diameter of the aperture 16 of the handle part, a head 42 at one end beneath which a spring 44 is held captive, and a cylindrical enlargement 46 at its other end which is provided with a groove 48 in which a retaining spring washer is fitted. The spring washer is provided, as shown, with a domed head 52 which encloses the end of the cylindrical enlargement 46. The arrangement is such that the blade provided with a tang identical to that illustrated in FIG. 2 can be connected to the handle part, the tang being entered into the aperture in the handle part when the head of the locking pin has been depressed against the force of the spring 44 to move the enlargement 46 clear of said aperture (that is to say the cylindrical major length 40 of the locking pin sliding along the slot in the tang as the latter is inserted in the handle part). When the head of the locking pin is then released, the force of the spring imparts a cross-movement of the locking pin to engage the enlargement 46 in the cross bore 24 of the tang. Of course it will be realised that in this case the cross bore 24 need not necessarily extend completely through the tang.

Various other modifications may of course be made without departing from the scope of the invention and it will be understood that although the blade part illustrated is that of a joiners chisel, numerous other kinds of hand tools or sets of hand tools may embody the invention, for example screwdrivers, painters and decorators tools and the like. Instead of the shoulder formed on the bolster abutting directly against the handle part there could be a thin shock washer (made for example of a synthetic plastics material) interposed between the two. It will also be understood that the manner in which the blade or tool and handle part are secured together permits a considerable amount of torque to be applied to the blade or tool, as for example to a screwdriver blade.

What I claim and desire to secure by Letters Patent is:

1. In a hand tool including a tool part provided with a tang having an axially extending slot in its free end opening into a cross hole, the diameter of the cross hole being greater than the width of the slot, and including a handle part having an aperture extending axially into one end for receiving the tang; locking means for locking the handle part to the tang comprising a locking pin extending diametrically through the handle intermediately of the ends of the aperture and adapted to be rotated relative to the handle, the pin having a first narrow diametrical dimension allowing sliding reception of the pin down the slot into the cross hole and having perpendicular to the first dimension a second diametral dimension greater than the width of the slot allowing locking of the pin against escape from the slot when the pin is rotated to a locking position in which its greater diametral dimension extends crosswise to the slot, a lever for rotating the pin pivotally connected to an external end of the pin, a spring retainer clip fitted on an opposite external end of the pin urging the lever connected end of the pin inwardly of the handle, the lever being pivotable from an inoperative angular position in a side recess of the handle to an operative position in axial extension of the pin, the lever being formed with lugs at an inner end thereof having cooperation with a side area of the handle when the lever is pivoted to its operative position to draw the lever connected end of the pin slightly outwardly of the handle against the opposed urging of the spring, said lugs being adapted to allow return of the pin by the spring inwardly of the handle upon pivoting the lever back to its inoperative position, and the said urging of the spring serving to retain the lever in its inoperative position.

* * * * *